United States Patent [19]

Love et al.

[11] 3,941,561

[45] Mar. 2, 1976

[54] METHOD OF PRODUCING DYED MATERIAL

[75] Inventors: Ronald Barr Love; Alistair Templeton Stewart, both of Paisley, Scotland

[73] Assignee: J & P Coats Limited, Glasgow, Scotland

[22] Filed: July 18, 1973

[21] Appl. No.: 380,258

Related U.S. Application Data

[62] Division of Ser. No. 221,831, Jan. 28, 1972, Pat. No. 3,790,342.

[30] Foreign Application Priority Data

| | | |
|---|---|---|
| Jan. 29, 1971 | United Kingdom | 3536/71 |
| Jan. 29, 1971 | United Kingdom | 3537/71 |
| Apr. 3, 1971 | United Kingdom | 8623/71 |

[52] U.S. Cl. ..... 8/92; 8/12; 8/173; 8/169; 8/93; 8/94 A; 8/174; 8/DIG. 1

[51] Int. Cl.[2] ..... D06P 1/62

[58] Field of Search ..... 8/DIG. 1, 93, 92, 94, 172, 8/173, 174, 169, 12

[56] References Cited

UNITED STATES PATENTS

| | | | |
|---|---|---|---|
| 2,828,180 | 3/1958 | Sertorio | 8/62 |
| 3,129,053 | 4/1964 | Castle | 8/93 |
| 3,709,656 | 1/1973 | Kusuhara | 8/17 |

OTHER PUBLICATIONS

Karrholm et al., Textile Research J. July 1956 pp. 528–53.

*Primary Examiner*—Donald Levy
*Attorney, Agent, or Firm*—Larson, Taylor and Hinds

[57] ABSTRACT

A process of producing a dyed cleaned material comprising first applying to virgin material a dyeing medium, next drying the material and then treating the material with a cleaning substance containing acetone. The acetone may be diluted with water in a proportion up to 50% water. The dyeing medium may be a non-aqueous solvent dyeing medium. The non-aqueous dyeing medium may be combined with a material for which the solvent has an affinity higher than it has for the dye.

3 Claims, No Drawings

METHOD OF PRODUCING DYED MATERIAL

This is a division of application Ser. No. 221,831 filed Jan. 28, 1972, now U.S. Pat. No. 3,790,342.

This invention relates to the production of dyed material such as yarns, threads, fabrics, tows, tops and loose stock, also to the production of dyed leather and other materials capable of being dyed.

When material is subjected to a dyeing operation usually some of the dye is absorbed and some of the dye remains on the surface of the thread or of the threads or fibres forming the fabric.

The surface dye (the unfixed dye) is in two forms, one of which is a loose unadherent form and the other of which is a more strongly adherent form. When the material is washed this surface dye washes off. Besides the trouble that the surface dye causes for example by damaging other articles being washed at the same time, the removal of the surface dye causes the shade of the dyed material to change. To remove all this surface dye completely immediately following the dyeing operation a lengthy cleaning operation has heretofore been necessary. This required an initial washing operation which removes the loose surface coating of dye and then a reduction clearing operation or detergent treatment to remove the more adherent surface coating which is not washed off by the washing operation. As the reduction clearing operation causes a chemical action to take place with resultant debris being left it is necessary to remove this debris by a subsequent washing operation using a detergent. The cleaning treatment may take up as much as 45% of the total time of the dyeing cycle and the dyeing cycle itself may take as long as five hours. It will be understood then that the cleaning treatment is an expensive adjunct to the dyeing operation, not only on account of the time taken, but also because of the trouble of having to subject the material to a number of further operations. In addition to the cleaning operation it is necessary to subject the material subsequently to a drying operation which itself is expensive because of the amount of heat which has to be applied to remove the aqueous constituent of the cleaning liquids.

It would thus be a great technical advance to provide a quick, simple, cheap, easily-performed process for producing dyed material free from loose surface dye.

It is an object of the present invention to provide such a process.

A process of producing a dyed cleaned material according to the invention consists in first applying to virgin material a dyeing medium, drying the material and then treating the material with a cleaning substance consisting of acetone in a proportion from 100 to 50% and a diluent in a proportion from 0 to 50%.

The diluent may be a neutral diluent such as water.

The efficiency of the process is usually enhanced by operating the process at a temperature above room temperature. A suitable temperature lies within the range 40°C – 50°C.

The process may include the step of drying the material after treatment with the cleaning substance.

The material may be treated by centrifuging the material with the cleaning substance or circulating the cleaning substance through the material or moving the material through the cleaning substance.

The method of drying may consist in forcing hot air through the dyed and cleaned material, or in removing the residual acetone at a sub-atmospheric pressure below the vapour pressure of the cleaning substance.

The dyeing medium may be an aqueous dye medium, i.e., a dye in which the dyestuff is dispersed or dissolved in water which may contain auxiliary chemicals as additives intended to function as, for example, dispersing agents and buffering agents.

Alternatively the dyeing medium may be a solvent dyeing medium. In this type of dyeing medium a dyestuff is dispersed or dissolved in a non-aqueous solvent.

The solvent dyeing medium may consist of a substance incorporating a dye, a solvent of the dye and a material for which the solvent has a higher affinity than it has for the dye.

The components of the solvent dyeing medium may be all mixed together in one mixing operation before application to the virgin material, or the solvent and the material for which the solvent has an affinity higher than it has for the dye may be mixed together and then the dye either in dry form or in paste form added, the final mix being applied to the virgin material.

Alternatively, the dyeing medium may include a first component substance incorporating a dye contained in a solvent and a second component substance incorporating the material for which the solvent has a higher affinity than it has for the dye, the two component substances being either mixed before application to the virgin material or being applied consecutively and separately to the virgin material.

Suitably the two component substances are in liquid form or at least one may consist of at least one solid dispersed or dissolved in a liquid phase.

The process may include the further step of subjecting the material to a washing operation in the same solvent alone as is used in the first component substance or in another solvent after it has been treated with the two component substances.

The ratio of the first component substance to the complete dyeing medium may be in the range of 90 to 5% and the ratio of the second component substance to the composite dyeing medium may be in the range of 10 to 95%.

The liquor ratio of the solvent dyeing medium to the material being dyed will normally lie between 1:1 and 100:1 but for certain purposes ratios outside of these limits may be used. Solvents with boiling points above the boiling point of water may conveniently be used and the temperature of dyeing is preferably held at a maximum of 30°C below the softening point of the material being dyed if this is synthetic material and about 10°C below the degradation temperature of a material which has no softening point e.g., a natural fibre. For solvents having boiling points above that of water a dyeing temperature lying in the range 130°C–140°C will normally be used. At these temperatures it may be found convenient to perform the process at a pressure above atmospheric.

The process is operable with textile material containing natural fibres and/or synthetic fibres.

For use with natural fibres suitable solvent dyestuffs are direct dyes, reactive dyes and azoic dyes. For use with synthetic fibres, disperse dyes may be used with polyester, polyamide, acetate and acrylic fibres and disperse dyes and acid dyes with nylon fibres.

Two types of solvents may be used. These are aliphatic solvents and aromatic solvents. The aliphatic solvents may be hydrocarbons, alcohols, halogenated hydrocarbons, aldehydes, ketones and esters. Aromatic solvents are hydrocarbons, phenols, aryl halides, aldehydes and ketones, and esters.

The second component substance may consist of a silicone fluid, an aliphatic solvent such as hydrocarbon (high boiling white spirit), an aliphatic halogenated hydrocarbon, an aromatic hydrocarbon or an aromatic halogenated hydrocarbon and includes mixture of these. In certain circumstances substances capable of controlling the levelness and penetration of the dyeing effect, urea is one such substance, may be incorporated in the second component substance.

Briefly stated, the mode of operation of the process is that solution of the dyestuff in the solvent to form the first component substance puts the dyestuff into a form suitable for transfer to the material to be dyed. When the first component substance is mixed with the second component substance the greater affinity of the solvent for the second component substance than it has for the dyestuff increases relatively the affinity of the dyestuff for the material being dyed and an enhanced dyeing effect is achieved.

The constituents of the component substances are readily chosen so that the component substances are non-explosive and virtually non-inflammable. As an example of such a mixture a first component substance contains perchloroethylene as the solvent and silicone fluid as the second component substance. Many of these solvents are readily available commercially, for example perchloroethylene is extensively used in the dry-cleaning industry.

Examples of suitable silicone fluids are low viscosity dimethyl-polysiloxanes. Other advantages possessed by these solvents are that they have high flash points, are virtually non-volatile, have no true boiling points, are neutral and are chemically inert.

The acetone performs all the required cleaning action in one operation, it dissolves not only the loose surface coating of dye but also the more strongly adherent surface dye which is not normally removed by the washing operation. In addition the acetone does not form by-products and acts with such speed that it can be applied for a time sufficient to remove the unfixed surface dye only, i.e., not to take out any of the fixed adsorbed dye.

The process can be operated as a batch dyeing process or as a continuous dyeing process.

Time savings of as much as 50% have been achieved by the process. This is equivalent to increasing the capacity of any existing dyeing machine by 100%.

A further saving in time is possible in the subsequent drying operation. Since acetone is much more volatile than water the time taken to evaporate the acetone out of the cleaned material is much less than it is in the equivalent conventional cleaning operation. Also since the latent heat of acetone is less than a quarter that of water the quantity of heat required to evaporate the acetone is also very much less than it is for the same quantity of the conventional cleaning substances which are almost all water. There is a consequent reduction in cost.

Although the process covers the use of aqueous dyes as well as solvent dyes and there are occasions where aqueous dyes are more suitable, it is preferable to use solvent dyes because the auxiliary chemicals usually required in the dye liquor not only reduce the concentration of the dyestuff but are troublesome in that they are difficult to render innocuous in the effluent from the dyeing process. It thus may require a considerable amount of expenditure in making the effluent sufficiently innocuous or otherwise harmless to discharge to a drainage system or to a river or stream. Another disadvantage of aqueous dyes in that water has high specific and latent heats and consequently the amount of heat required to dry the dyed material contributes substantially to the cost of the dyeing process.

A further advantage of the use of solvent dyes is that the material being dyed is more rapidly wetted by these non-aqueous solvents and that textile materials do not swell as much in the non-aqueous solvents as they do in water.

It is to be understood that the method of applying the substance or the component substances to the virgin material includes any practicable process, e.g., immersion of the virgin material in the substance or component substances, pumping the substances or the component substances through the virgin material, or printing the substances or the component substances on to the virgin material, or any combination of these processes or other practicable processes.

It is also to be understood that although for convenience the process has sometimes been previously described as being for the production of dyed textile material, the process is effective in producing dyed material from any textile or non-textile virgin material which is capable of being dyed. Such a non-textile material is leather.

It is also to be understood that the virgin material may already have been treated in some fashion e.g., it may have been bleached or may have been already dyed or printed.

What is claimed is:

1. A process of dyeing comprising applying to material to be dyed a solvent dyeing medium comprising a dye, a solvent of the dye selected from the group consisting of aliphatic hydrocarbons, aliphatic alcohols, halogenated aliphatic hydrocarbons, aliphatic aldehydes, aliphatic ketones, aliphatic esters, aromatic hydrocarbons, phenols, aryl halides, aromatic aldehydes, aromatic ketones, and aromatic esters and a dimethyl-polysiloxane for which the solvent has a higher affinity than it has for the dye, the ratio of the dye in its solvent to the complete dyeing medium being in the range of 90 to 5% and the ratio of the material for which the solvent has a higher affinity that it has for the dye to the complete dyeing medium being in the range of 10 to 95%.

2. A process as claimed in claim 1 in which the solvent incorporates perchloroethylene.

3. A process as claimed in claim 1 in which the silicone fluid is a low viscosity dimethyl-polysiloxane.

* * * * *